US009362648B2

(12) United States Patent
Fang et al.

(10) Patent No.: US 9,362,648 B2
(45) Date of Patent: Jun. 7, 2016

(54) ELECTRICAL CONNECTOR

(71) Applicant: HON HAI PRECISION INDUSTRY CO., LTD., New Taipei (TW)

(72) Inventors: Al-Hong Fang, Kunshan (CN); I-Fan Yen, New Taipei (TW); Huo-Xing Jin, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 163 days.

(21) Appl. No.: 13/909,111

(22) Filed: Jun. 4, 2013

(65) Prior Publication Data

US 2014/0127950 A1 May 8, 2014

(30) Foreign Application Priority Data

Nov. 2, 2012 (CN) ..... 2012 2 0572229 U

(51) Int. Cl.

| | |
|---|---|
| ***H01R 24/00*** | (2011.01) |
| ***H01R 13/405*** | (2006.01) |
| *H01R 12/70* | (2011.01) |
| *H01R 43/24* | (2006.01) |

(52) U.S. Cl.

CPC ..... *H01R 13/405* (2013.01); *H01R 12/707* (2013.01); *H01R 43/24* (2013.01)

(58) Field of Classification Search

CPC ..... H01R 13/02; H01R 13/26; H01R 13/41; H01R 13/62; H01R 13/405; H01R 24/00; H01R 43/24; H01R 9/09

USPC ..... 439/74, 676, 660, 736, 722, 752.5, 751, 439/680, 681, 686, 696, 60, 78, 842, 607.01

See application file for complete search history.

(56) References Cited

U.S. PATENT DOCUMENTS

| | | | | |
|---|---|---|---|---|
| 4,392,705 | A * | 7/1983 | Andrews et al. | 439/342 |
| 5,772,474 | A * | 6/1998 | Yagi et al. | 439/660 |
| 5,795,194 | A * | 8/1998 | Hahn | 439/660 |
| 5,967,841 | A * | 10/1999 | Bianca et al. | 439/590 |
| 6,010,370 | A * | 1/2000 | Aihara et al. | 439/660 |
| 6,558,202 | B1 * | 5/2003 | Hahn | 439/660 |
| 7,090,502 | B2 * | 8/2006 | Ono et al. | 439/65 |
| 7,637,786 | B2 * | 12/2009 | Hoshino et al. | 439/660 |
| 7,717,719 | B2 * | 5/2010 | Miyazaki et al. | 439/74 |
| 2002/0061683 | A1 * | 5/2002 | Fukui | 439/660 |
| 2005/0032438 | A1 * | 2/2005 | Huang et al. | 439/736 |

FOREIGN PATENT DOCUMENTS

| | | |
|---|---|---|
| TW | M445677 | 7/2001 |

* cited by examiner

*Primary Examiner* — Amy Cohen Johnson
*Assistant Examiner* — Milagros Jeancharles
(74) *Attorney, Agent, or Firm* — Wei Te Chung; Ming Chieh Chang

(57) ABSTRACT

An electrical connector comprises an insulative housing and a plurality of conductive terminals fixed to the insulative housing. The insulative housing includes a pair of longer walls and a pair of short walls bounding a plug-receiving cavity with an insertion direction. The conductive terminals include plate portions partly embedded in inner surfaces of the longer walls and welded portions extending out of the insulative housing. The inner surface of the longer walls define Positioning grooves between every adjacent terminals. Each of the plate portion of the conductive terminal defines a contacting surface faced to the plug-receiving cavity and two side edges intersecting with the opening edge of corresponding Positioning groove. The structure of the connector contributes to an insert molding of the connector. It is convenient not only to terminal implant and but also to a precise positioning of two directions of the terminals during the insert molding process.

1 Claim, 7 Drawing Sheets

ELECTRICAL CONNECTOR

BACKGROUND OF THE INVENTION

1. Field of the Invention

The present invention relates to an electrical connector, and more particularly to an electrical connector with a new insert-molding method for terminal retaining.

2. Description of the Related Art

U.S. Pat. No. 6,010,370 issued on Jan. 4, 2000, issued to Molex Incorporated. discloses an electrical connector including: an insulative housing, and a plurality of conductive terminals fixed to the housing. The housing defines a pair of long walls and a pair of short walls bounding a plug-receiving cavity with an insertion direction. The said terminals are arranged with a predetermined distance on the side surfaces and the upper surfaces along a longitudinal direction of the housing. Each terminal defines a solder portion, a connecting portion and a base portion connecting with the solder portion and the connecting portion. Both the long walls have a plurality of rectangle grooves between every two adjacent terminals, and the connecting portions are set in the grooves. Since the grooves are rectangle-shaped, it is hard to position the terminals into the grooves before the insert-molding process and it is not benefit to demoulding.

Therefore, an improved electrical connector is desired to overcome the disadvantages of the related arts.

BRIEF SUMMARY OF THE INVENTION

An object of the present invention is to provide an electrical connector which is easier to position terminals during forming the connector by a insert-molding process.

In order to achieve above-mentioned object, an electrical connector including an insulative housing, a plurality of conductive terminals fixed to the insulative housing. The insulative housing defines a pair of long walls and a pair of short walls bounding a plug-receiving cavity with an insertion direction. The conductive terminals include plate portions partly embedded in inner surfaces of the long walls and welded portions extending out of the insulative housing. The inner surfaces of the longer walls define positioning grooves between every adjacent terminals. Each of the plate portion of the conductive terminal defines a contacting surface faced to the plug-receiving cavity and two side edges intersecting with the opening edge of corresponding positioning groove.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
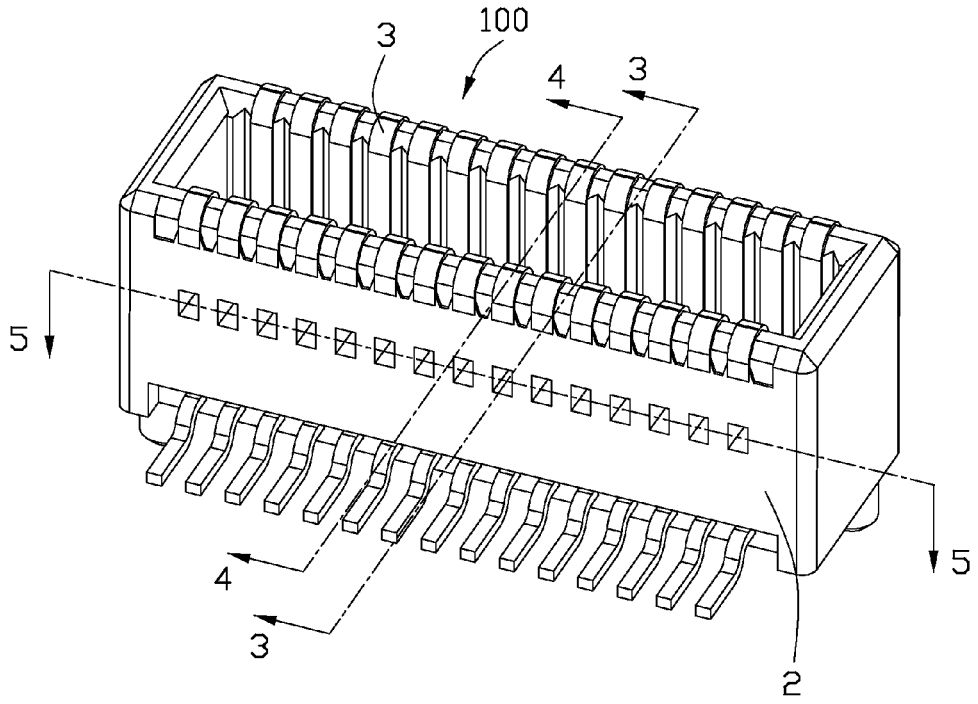
FIG. 1 is a perspective view of an electrical connector in accordance with the present invention.

Reference will now be made to the drawing figures to describe a preferred embodiment of the present invention in detail. Referring to FIGS. 1 illustrates an electrical connector 100, the electrical connector 100 includes an insulative housing 2, and a plurality of conductive terminals 3 embedded in the insulative housing 2. The invention introduces a new way for the terminals' positioning, and it is easy to manufacture the electrical connector.

Figure 2:
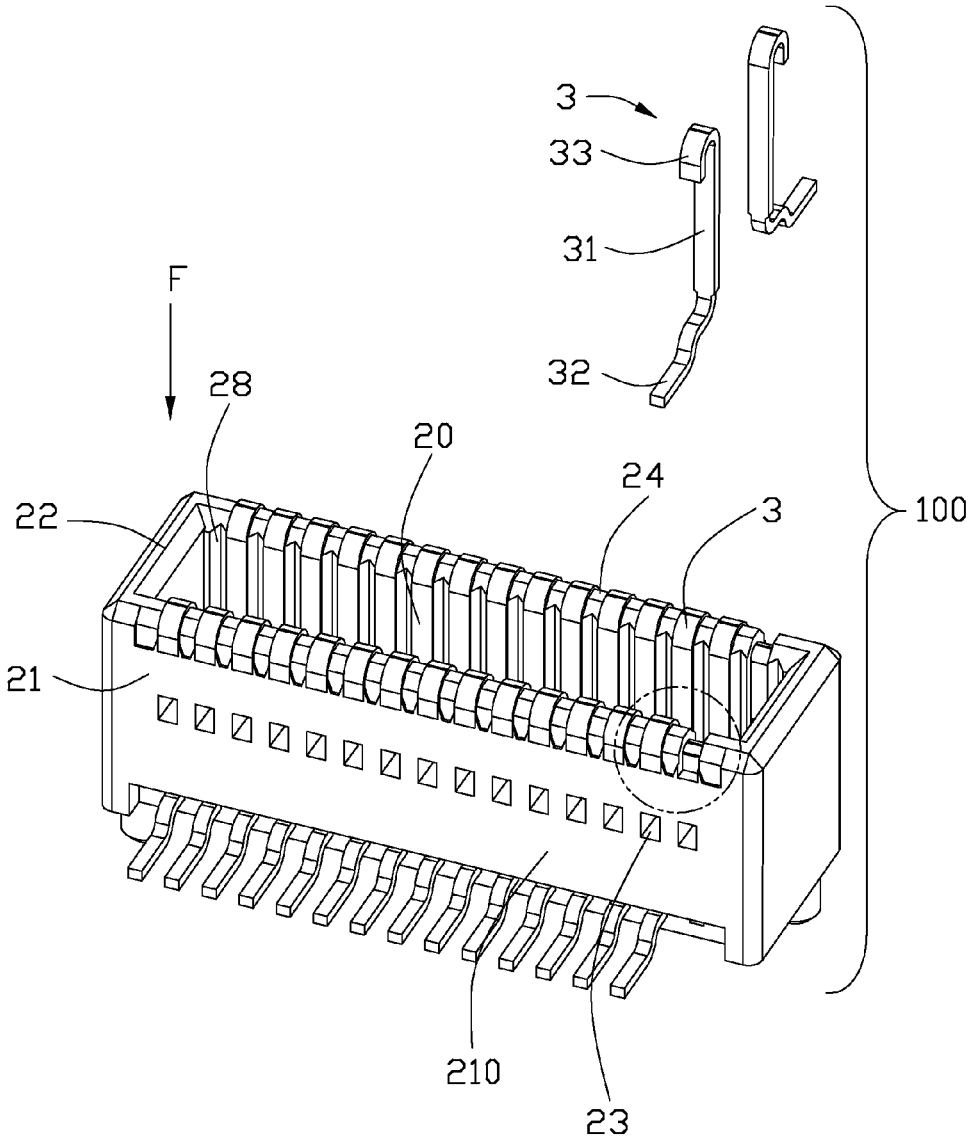
FIG. 2 is a partially exploded perspective view of the electrical connector shown in FIG. 1.
Figure 3:
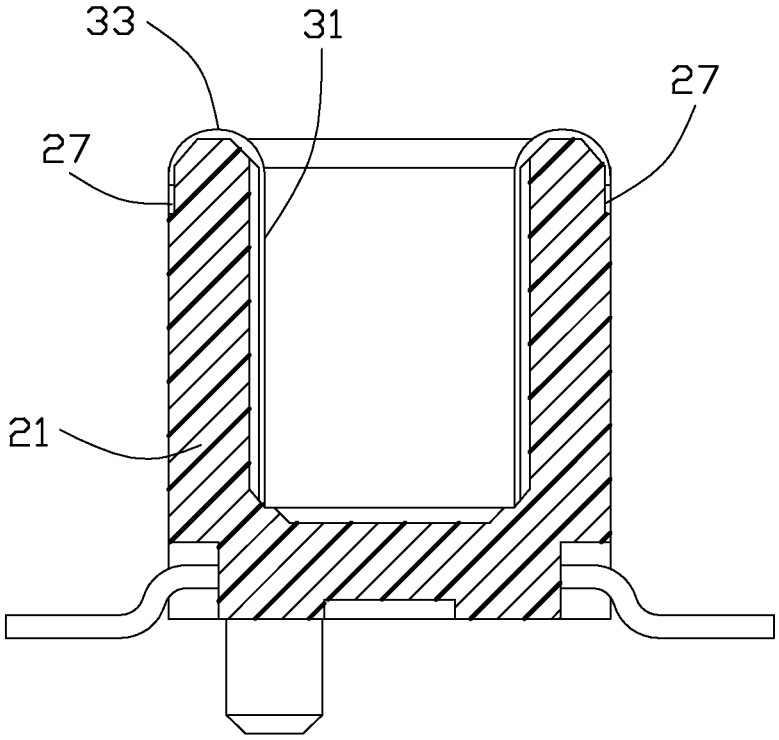
FIG. 3 is a cross sectional view taken along the line 3-3 shown in FIG. 1.
Figure 4:
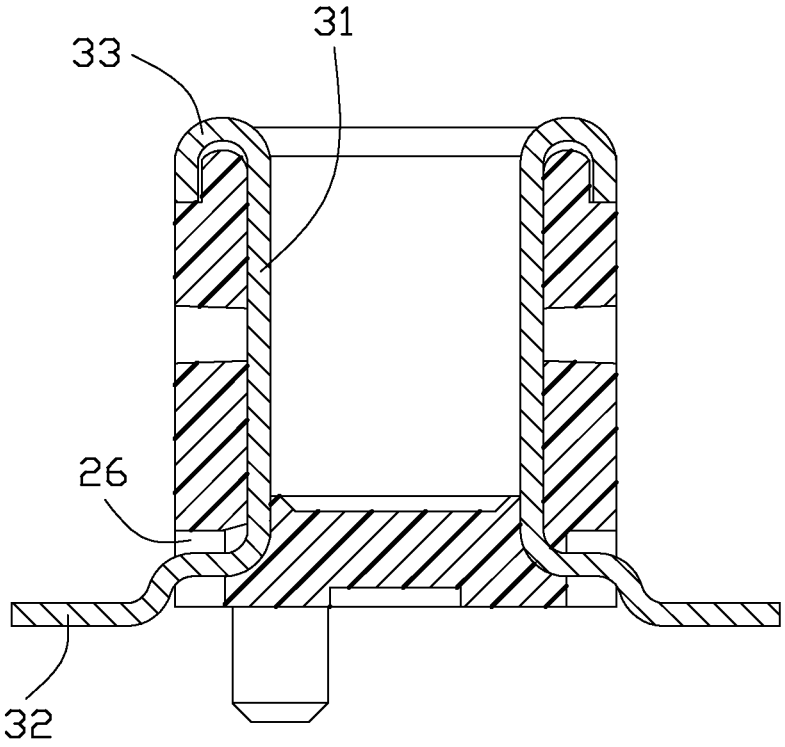
FIG. 4 is a cross sectional view taken along the line 4-4 shown in FIG. 1.

Referring to FIGS. 2 to 4, the insulative housing 2 is made from insulative material, such as plastic, etc., by injection molding process, and comprises a pair of side walls or long walls 21, and a pair of end walls or short walls 22 laterally connecting with the long walls 21. And a plurality of holes 23 run through the outer surfaces 210 of the long walls 21 and arranged corresponding to the terminals 3 one by one.

The long walls 21 and the short walls 22 define a plug-receiving cavity 20 thereamong with an insertion direction F. The plug-receiving cavity 20 defines inner surfaces where the terminals are located. Please notes, the housing 2 is shaped by an insert-molding method. The manufacture procedure can be realized as follows. Firstly, the plurality of terminals 3 is stamped and formed with a predetermined shaped. Secondly, the terminals 3 are pre-positioned into a cavity mold and then the melted insulative material is injected into the cavity mold. Finally, the mold core is spared from the mold cavity after the terminals 3 and the housing 2 are cooled down. Therefore, the electrical connector 100 is shaped. Each terminal 3 defines a plate portion 31 partially embedded into the inner surface of the long wall 21, and a welded portion 32 extending from the lower end of the plate portion 31 out the housing 2. A head portion 33 extending from the upper end of the plate portion 31, bends outward so as to be constructed on the upper surface 24 of the long wall 21 and extends to the outer surface 210 of the long wall 21. The head portions 33 are aligned with the holes 23 one by one and located over the holes 23 in a vertical direction of the electrical connector 100. The plate portions 31 of the terminals 3 are at least partially embedded in the long walls 21 and partially expose to the plug-receiving cavity, and the holes 23 are aligned with the corresponding plate portions 31 (as best shown in FIG. 3 and FIG. 4).

Scoop portions 26 are shaped adjacent to the welded portions 32 at the outer surfaces 210 of the long walls 21, which are shaped due to extraction of the mold core. The welded portions 32 are bended three times from the lower end of the plate portions 31. The upper parts of the welded portions 32 are located in the long walls 21 and the lower parts of the welded portions 32 extend out of the housing 2.

Figure 5:
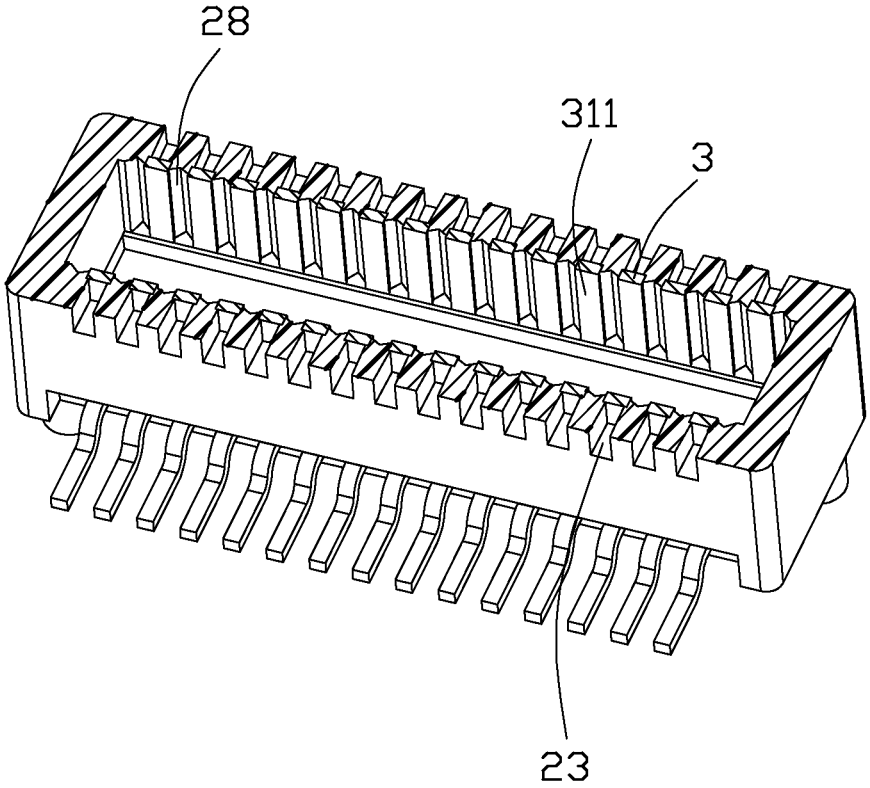
FIG. 5 is a perspective view of the connector, wherein the upper half part is cut away along the line 5-5 shown in FIG. 1.
Figure 6:
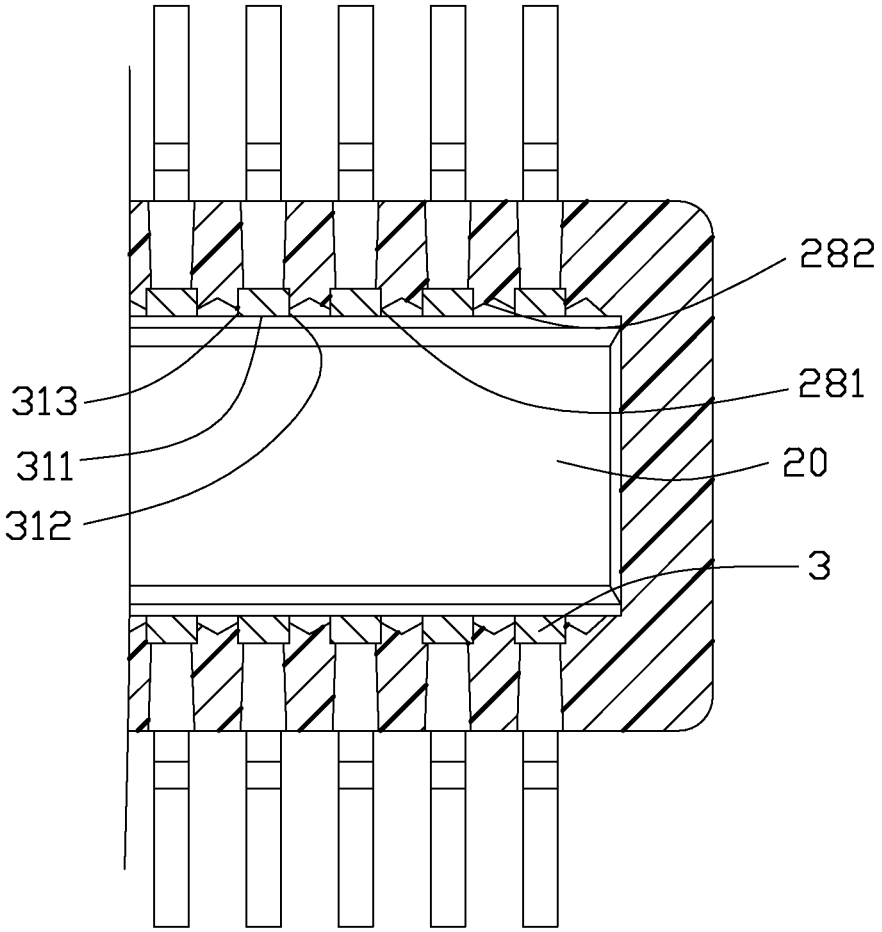
FIG. 6 is a top view of the electrical connector shown in FIG. 5.

Referring to FIG. 5 to FIG. 6, a plurality of positioning grooves 28 are formed on the inner surface of the longer walls 21. The positioning grooves 28 extend parallel to terminals 3 and are located between two adjacent terminals 3. The positioning grooves 28 are formed after the mold core for terminals positioning is extracted from the cavity mold. The surfaces exposing to plug-receiving cavity 20 of the plate portions 31 are defined as contacting surfaces 311, each contacting surface 311 defines two opposite side edges 312, 313 which are intersecting with the opening edges 281 of each positioning groove 28. During the procedure of the manufacture, the portions of the mold core in positioning grooves 28 are resisting against two opposite side edges 312, 313 of the terminals 3, so that the positioning of terminals 3 in a contacting arrangement direction or longitudinal direction can be acquired. The portions of the mold core inserted into the positioning grooves 28 limit every two adjacent terminals 3 in the longitudinal direction. As understandably from the drawings, since the mold core is composed with a plurality of inverted V-shape, the positioning grooves 28 are in an V shape corresponding to the mold core. A distance between two adjacent tip points of inverted V-shape of the mold core is larger than that between two adjacent valley points of the mold core, which make it easier to put the terminals 3 into the mold core. In a preferred embodiment, the side edges 312, 313 of the terminals protrude into the plug-receiving cavity 20 beyond the opening edges 281 of the positioning grooves 28, which benefits in the implantation and embedment of the terminals into the cavity mold. Each positioning groove 28 defines two incline surfaces 282 intersecting at one tip line, the opening edge 281 is formed at the side of each incline surface 282. The distance between the opening edges 281 of two incline surfaces 282 of one positioning groove 28 equals to the distance between two adjacent terminals 3. The positioning grooves 28 are parallel to the insertion direction F, and run upwardly through the upper surface 24 of the long walls 21 and extend downwardly over the bottom surface of the plug-receiving cavity 20. The plate portions 31 of the terminals 3 project beyond the opening edges 281 of positioning grooves 28.

Figure 7:
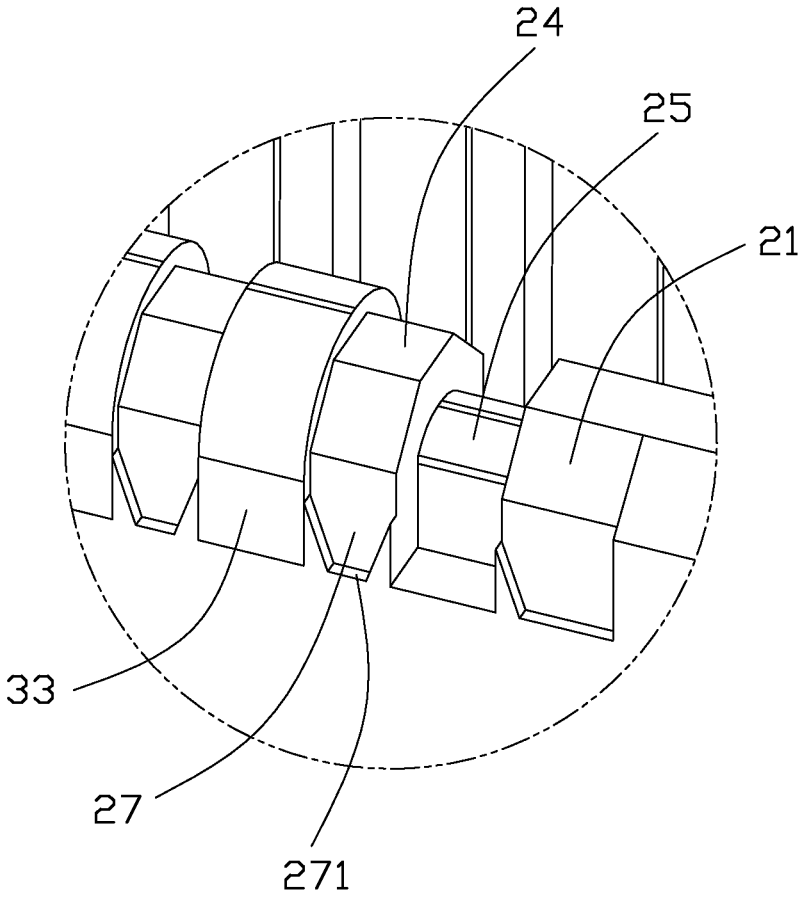
FIG. 7 is a partially enlarged view of the electrical connector circled in FIG. 2.

Referring to FIG. 3 and FIG. 7, part of the head portion 33 of the terminal 3 is embedded into the longer walls 21, and part is protruding out of the upper surface 24 of the long wall 21. A plurality of terminal passageways 25 are left when terminals 3 are removed. Grooves 27 are left on the outer surfaces of the long walls 21 between every two adjacent terminal passageways 25 after mold core is removed from the cavity mold, and the groove 27 is V-shaped. The grooves 27 run through the upper surface 24 of the long walls 21 and define bottom surfaces 271 which are flush with the ends of the head portions 33 of the terminals 3. From the direction parallel to the short wall, the ends of grooves 27 are Ladder-shaped, the ends of terminal recesses 25 are rectangle-shaped, and the width of the bottom surface 271 is smaller than the distance between the side edges of adjacent terminals 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing including a pair of longitudinal walls and a pair of transverse walls to commonly define therein an elongated plug-receiving cavity along a longitudinal direction, each of said longitudinal walls defining an interior surface facing toward the plug-receiving cavity in a transverse direction perpendicular to said longitudinal direction, said plug-receiving cavity upwardly communicating to an exterior in a vertical direction perpendicular to both said longitudinal direction and said transverse direction;

two rows of contacts disposed in the housing with contacting sections extending along the vertical direction on the corresponding interior surfaces, respectively, each of said contacting sections defining a candy-cane configuration viewed in the longitudinal direction with an upper portion defining an upside-down U-shaped configuration straddling an upper ledge of each of the longitudinal walls with a tip region exposed upon an exterior surface of the corresponding longitudinal wall; and each of said contacting sections defining a thickness, along said transverse direction, of which a portion is hidden under the interior surface and the exterior surface of the corresponding longitudinal wall; wherein each of said longitudinal walls defines a plurality of grooves, in the corresponding interior surface, each of said grooves located between two corresponding contacting sections of the corresponding adjacent two contacts; wherein two opposite side edges of the contacting section of each of said contacts, which are partially exposed upon the corresponding interior surface and to the exterior, face respectively toward the neighboring grooves in generally the longitudinal direction; wherein each of said grooves defines a cross-sectional recessed structure along an extension direction;

wherein each of said grooves, having a uniform depth, extends along the interior surface from the upper ledge of each of the longitudinal walls and terminates at a bottom surface of the plug receiving cavity; wherein the exposed side edges of the contacting section extend along the interior surface from the upper ledge of each of the longitudinal walls and terminate at said bottom surface of the plug receiving cavity.

* * * * *